US005998115A

United States Patent [19]

Bringley et al.

[11] Patent Number: 5,998,115

[45] Date of Patent: Dec. 7, 1999

[54] PHOTOGRAPHIC ELEMENTS CONTAINING COMPOSITE REFLECTIVE GRAINS

[75] Inventors: Joseph F. Bringley; James A. Friday, both of Rochester; Thomas B. Brust, Webster, all of N.Y.

[73] Assignee: Eastman Kodak Company, Rochester, N.Y.

[21] Appl. No.: 09/292,500

[22] Filed: Apr. 15, 1999

[51] Int. Cl.[6] ..... G03C 1/035; G03C 1/46

[52] U.S. Cl. ..... 430/506; 430/509; 430/567

[58] Field of Search ..... 430/567, 506, 430/509

[56] References Cited

U.S. PATENT DOCUMENTS

| | | | |
|---|---|---|---|
| 4,388,401 | 6/1983 | Hasebe et al. | 430/505 |
| 4,435,501 | 3/1984 | Maskasky | 430/434 |
| 4,439,520 | 3/1984 | Kofron et al. | 430/434 |
| 4,640,890 | 2/1987 | Fujita et al. | 430/504 |
| 4,751,174 | 6/1988 | Toya | 430/502 |
| 5,275,929 | 1/1994 | Buitano et al. | 430/567 |
| 5,302,499 | 4/1994 | Merrill et al. | 430/503 |
| 5,314,793 | 5/1994 | Chang et al. | 430/506 |
| 5,494,789 | 2/1996 | Daubendiek et al. | 430/567 |
| 5,503,971 | 4/1996 | Daubendiek et al. | 430/567 |
| 5,576,168 | 11/1996 | Daubendiek et al. | 430/567 |
| 5,582,965 | 12/1996 | Deaton et al. | 430/567 |
| 5,612,175 | 3/1997 | Eshelman et al. | 430/567 |
| 5,612,176 | 3/1997 | Eshelman et al. | 430/567 |
| 5,612,177 | 3/1997 | Levy et al. | 430/567 |
| 5,614,359 | 3/1997 | Eshelman et al. | 430/567 |

OTHER PUBLICATIONS

Keller "Science and Technology of Photography", VCH New York, 1993, 3.2.16 Antihalation Coatings, pp. 68 & 69.

"Research Disclosure", vol. 389, Sep. 1996, Item 38957, I.

*Primary Examiner*—Mark F. Huff

*Attorney, Agent, or Firm*—Carl O. Thomas

[57] ABSTRACT

A photographic element is disclosed that relies upon high bromide silver halide grains that are sulfur and/or gold sensitized for latent image formation. Coated to receive exposing radiation directly from a layer containing the latent image forming grains is a non-imaging layer containing (a) tabular silver halide grains (i) comprised of greater than 50 mole percent bromide, based on silver, (ii) having a thickness in the range of from 0.03 to 0.20 $\mu$m, and (iii) having an average aspect ratio of greater than 20, and (b) silver halide epitaxy selectively positioned adjacent edges of said tabular grains in said non-imaging layer, said silver halide epitaxy (i) containing greater than 50 mole percent chloride, based on silver, and (ii) accounting for from 0.1 to 50 percent of the total silver in the composite grains.

11 Claims, No Drawings

PHOTOGRAPHIC ELEMENTS CONTAINING COMPOSITE REFLECTIVE GRAINS

FIELD OF THE INVENTION

Photographic elements are disclosed that exhibit increased speed with little reduction in sharpness. Specifically, the invention relates to photographic elements that employ middle chalcogen and/or noble metal sensitized high bromide silver halide emulsions.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "{111} tabular" in referring to grains and emulsions indicates those in which the tabular grains have parallel major crystal faces lying in {111} crystal planes.

The term "regular" in referring to grains indicates that the grains are internally free crystal plane stacking faults, such as twin planes and screw dislocations.

The terms "high bromide" and "high chloride" in referring to grains and emulsions indicates that bromide or chloride, respectively, is present in a concentration greater than 50 mole percent, based on total silver.

In referring to silver halide grains and emulsions containing two or more halides, the halides are named in order of ascending concentrations.

The term "epitaxy" indicates a first crystal lattice structure that derives its orientation from a second, differing (host) crystal lattice structure on which the first crystal lattice structure is grown.

The term "edge" is employed to indicate the peripheral edges (including corners) of the parallel {111} major faces of tabular grains and all of the minor crystal faces intersecting the major face edges and/or the edges of twin planes parallel to the major crystal faces.

The term "middle chalcogen" refers to he elements sulfur, selenium and tellurium.

The terms "blue", "green" and "red" indicate the portions of the visible spectrum lying, respectively, within the wavelength ranges of from 400 to 500 nm, 500 to 600 nm and 600 to 700 nm.

The term "minus blue" indicates the visible portion of the spectrum outside the blue portion of the spectrum—e.g., any spectral region in the range of from 500 to 700 nm.

The term "half peak absorption bandwidth" indicates the spectral region over which a dye exhibits an absorption equal to at least half its peak absorption.

The terms "front" and "back" indicate a position that is nearer or farther, respectively, than the support from the source of exposing radiation.

The terms "above" and "below" indicate a position nearer or farther, respectively, from the source of exposing radiation.

The term "subject" designates the person(s) and/or object (s) photographed.

The term "stop" in comparing photographic speeds indicates an exposure difference of 0.3 log E required to produce he same reference density, where E is exposure in lux-seconds. The term "photographic element" is employed to encompass elements that record imagewise exposures within the visible region of the spectrum. Thus, radiographic elements that record X-ray stimulated intensifying screen emissions within the visible region of the spectrum satisfy the photographic element definition.

*Research Disclosure* is published by Kenneth Mason Publications, Ltd., Dudley House, 12 North St., Emsworth, Hampshire P010 7DQ, England.

BACKGROUND OF THE INVENTION

It is well known in the silver halide photography that incident light used for imagewise exposure of a radiation-sensitive silver halide emulsion layer is only partially absorbed within that layer. If exposing light that has passed through the emulsion layer is reflected back, the reflected light, to the extent that it is absorbed during its second traverse, acts to increase the effective speed of the silver halide emulsion layer. Unfortunately, reflected light is known to reduce greatly image sharpness. In fact, the term "halation" was coined early in photography to describe this effect, since a bright object that is photographed without protection against reflected light appears to be surrounded by a halo, attributable to scattered reflected light. To avoid halation, it is a common practice to coat beneath the radiation-sensitive silver halide emulsion layer or layers of a photographic element an antihalation layer. The function of the antihalation layer is absorb light that has passed through the overlying emulsion layer or layers during imagewise exposure. Antihalation is described by Keller *Science and Technology of Photography*, VCH, New York, 1993, 3.2.16. Antihalation Coatings, pp. 68 and 69.

Kofron et al U.S. Pat. No. 4,439,520 demonstrates that the image sharpness of an underlying silver halide emulsion layer is increased when an overlying radiation-sensitive silver halide emulsion layer is selected to contain a high (>8) aspect ratio tabular grain emulsion.

The use of silver halide epitaxy to increase the sensitivity of high aspect ratio tabular grain emulsions was first disclosed by Maskasky U.S. Pat. No. 4,435,501. Other illustrations of composite grains formed by epitaxial deposition are provided by *Research Disclosure*, Vol. 389, September 1996, Item 38957, I. Emulsion grains and their preparation, A. Grain halide compositions, paragraph (7). More recent illustrations of silver halide epitaxy applied to tabular host grains are provided by Daubendiek et al U.S. Pat. Nos. 5,494,739, 5,503,971 and 5,576,168, Deaton et al U.S. Pat. No. 5,582,965, Eshelman et al U.S. Pat. Nos. 5,612,175, 5,612,176 and 5,614,359, and Levy U.S. Pat. No. 5,612,177.

RELATED APPLICATIONS

Bringley, Friday and Bryant co-pending, commonly assigned patent application U.S. Ser. No. 09/283,739, filed Apr. 1, 1999, (Docket 78742) titled COLOR PHOTOGRAPHIC FILM EXHIBITING INCREASED BLUE SPEED is directed to a color photographic element containing in its blue recording layer unit a blue light reflective layer positioned to receive light from a layer in the blue recording layer unit containing latent image forming silver halide grains of maximum sensitivity. The blue light reflective layer is free of blue absorbing dye and contains tabular silver halide grain having a thickness in the range of from 0.12 to 0.15 μm, an average aspect ratio of greater than 15, and a coating coverage of 0.5 to 1.5 g/m$^2$, and are formed of greater than 50 mole percent bromide, based on silver.

Bringley, Friday and Bryant co-pending, commonly assigned patent application U.S. Ser. No. 09/286,634, filed Apr. 5, 1999, (Docket 78743) titled COLOR PHOTOGRAPHIC FILM WITH INVERTED BLUE RECORDING LAYERS is directed to a color photographic element containing in its blue recording layer unit a blue light reflective layer positioned to receive light from first and second latent image forming layers in the blue recording layer unit. The first layer overlies the second layer and contains a silver coating coverages in the range of from 0.1 to 0.7 g/m$^2$. The second layer contains latent image forming silver halide grains of maximum sensitivity. The blue light reflective layer is free of blue absorbing dye and contains tabular silver halide grains which have a thickness in the range of from 0.12 to 0.15 μm, an average aspect ratio of greater than 15, and a coating coverage of 0.5 to 1.5 g/m$^2$, and are formed of greater than 50 mole percent bromide, based on silver.

Bringley, Friday and Bryant copending, commonly assigned patent application U.S. Ser. No. 09/286,897, filed Apr. 6, 1999, (Docket 78,744) titled COLOR PHOTOGRAPHIC FILM WITH A PLURALITY OF GRAIN POPULATIONS IN ITS BLUE RECORDING LAYER UNIT is directed to a color photographic element containing in its blue recording layer unit a blue light reflective layer positioned to receive light from a layer in the blue recording layer unit containing latent image forming silver halide grains of maximum sensitivity. The blue light reflective layer is free of blue absorbing dye and contains tabular silver halide grains having a thickness; in the range of from 0.12 to 0.15 μm, an average aspect ratio of greater than 15, and a coating coverage of 0.5 to 1.5 g/m$^2$, and are formed of greater than 50 mole percent bromide, based on silver. The layer containing grains of maximum sensitivity additionally contains from 0.01 to 0.5 g/m$^2$ of randomly oriented grains having an ECD in the range of from 0.01 to 0.5 μm.

Bringley and Friday copending, commonly assigned patent application U.S. Ser. No. 0/9/292,147, filed Apr. 15, 1999, titled COLOR PHOTOGRAPHIC FILM EXHIBITING INCREASED RED SPEED AND SHARPNESS, (Docket 79,216) discloses a color photographic element comprised of a transparent film support and, coated on the support, a red recording layer unit containing the radiation-sensitive silver halide grains in a plurality of emulsion layers with each emulsion layer located to receive exposing radiation prior to an underlying emulsion layer containing silver halide grains of higher sensitivity than the silver halide grains located in the underlying emulsion layer. The red light reflective layer is free of red absorbing dye and contains tabular silver halide grains having a thickness in the range of from 0.03 to 0.12 μm, an average aspect ratio of greater than 20, and a coating coverage of 0.5 to 1.25 g/m$^2$, and formed of greater than 50 mole percent bromide, based on silver. The reflective layer is located in the red recording layer unit interposed between two emulsion layers.

Bringley and Friday copending, commonly assigned patent application U.S. Ser. No. 09/292,421, filed Apr. 15, 1999, titled COLOR PHOTOGRAPHIC FILM WITH A PLURALITY OF GRAIN POPULATIONS IN ITS RED RECORDING LAYER UNIT, (Docket 79,299) discloses a color photographic element comprised of a transparent film support and, coated on the support, a red recording layer unit containing the latent image forming silver halide grains in a plurality of emulsion ayers with the latent image forming silver halide grains of maximum sensitivity being the first red recording emulsion layer to receive exposing radiation and containing randomly oriented red light scattering silver halide grains free of adsorbed spectral sensitizing dye. An optional layer coated beneath the first layer contains tabular silver halide grains to reflect red light. Improvements in imaging speed with improvements or relatively low losses in image sharpness are realized.

PROBLEM TO BE SOLVED

As image capture color photographic films have been constricted at progressively higher photographic speeds, difficulty has been encountered in obtaining higher imaging speeds without excessive degradation of image sharpness. The most common approach to increasing the imaging speed of silver halide photographic elements is to increase the average size of the latent image forming silver halide grains. Unfortunately, it is well recognized in the art that each stop increase in speed arrived at by increasing grain size can be expected to increase image granularity by 7 grains units.

SUMMARY OF TILE INVENTION

In one aspect, this invention is directed to a photographic element comprised of a transparent film support and, coated on the support, at least one image forming emulsion layer containing radiation-sensitive silver halide grains (i) comprised of greater than 50 mole percent bromide, based on silver, and (ii) chemically sensitized with at least one of middle chalcogen and noble metal sensitizers, wherein, coated to receive exposing radiation directly from the image forming emulsion layer is a non-imaging layer that does not form a viewable image upon imagewise exposure and processing, the non-imaging layer containing composite silver halide grains coated at a coverage of 0.1 to 1.5 g/m$^2$ formed by (a) tabular silver halide grains (i) comprised of greater than 50 mole percent bromide, based on silver, (ii) having a thickness in the range of from 0.03 to 0.20 μm, and (iii) having an average aspect ratio of greater than 20, and (b) silver halide epitaxy selectively positioned adjacent edges of the tabular grains in said non-imaging layer, said silver halide epitaxy (i) containing greater than 50 mole percent chloride, based on silver, and (ii) accounting for from 0.1 to 50 percent of the total silver in the composite grains.

It has been discovered that the presence of reflective tabular grains selected as described above for incorporation in a layer beneath one or more latent image forming high bromide silver halide emulsion layers produces photographic elements of increased speed that exhibit little, if any, degradation in image sharpness.

It has been also discovered that the association of high chloride silver halide epitaxy with the edges of the reflective tabular grains further increases imaging speed without any significant effect on image sharpness. The additional increase in speed was unexpected, since the reflective tabular grains, with or without epitaxy, are not sites at which latent image formation occurs.

DETAILED DESCRIPTION OF THE INVENTION

A simple construction of a photographic element satisfying the requirements of the invention is illustrated by the following:

Protective Overcoat
Latent Image Forming Emulsion Layer
Reflective Layer
Transparent Film Support
Antihalation Layer
(I)

The latent image forming emulsion layer contains high bromide silver halide grains for latent image formation upon imagewise exposure. The high bromide grains preferably each contain greater thin 70 mole percent bromide and optimally greater than 90 mole percent bromide, based on total silver. The grains can form latent image sites at the surface of the grains, internally or at both locations, but preferably form latent image sites primarily at the surface of the grains. The portion of the silver halide not accounted for by silver bromide can be any convenient conventional concentration of silver iodide and/or chloride. Silver iodide can be present up to its solubility limit in silver bromide, typically cited as 40 mole percent, based on total silver. However, iodide concentrations of less than 20 mole percent are preferred and iodide concentrations of less than 10 mole percent, based on total silver, are most preferred. For radiographic and other applications requiring high speed processing (dry-to-(dry processing in less than 60 seconds), the iodide content of the grains is preferably less than 4 mole percent, based on silver. Silver chloride concentrations are preferably limited to less than 30 mole percent and optimally less than 10 mole percent, based on total silver. Silver bromide and silver iodobromide grain compositions are specifically preferred. The latent image forming silver halide grains can take the form of those disclosed in *Research Disclosure*, Item 38957, cited above, I. Emulsion grains and their preparation.

In a specifically preferred form the latent image forming silver halide grains are chosen from among conventional high bromide tabular grain latent image forming emulsions. Specific illustrations of high bromide tabular grain emulsions are provided by the following patents, riere incorporated by reference:

List T

Daubendiek et al U.S. Pat. No. 4,414,310;
Abbott et al U.S. Pat. No. 4,425,426;
Wilgus et al U.S. Pat. No. 4,434,226;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendick et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840;
Delton U.S. Pat. No. 5,372,927;
Maskasky U.S. Pat. No. 5,604,085;
Maskasky U.S. Pat. No. 5,620,840;
Irving et al U.S. Pat. No. 5,667,954;
Maskasky U.S. Pat. No. 5,667,955;
Maskasky U.S. Pat. No. 5,691,131;
Maskasky U.S. Pat. No. 5,693,459;
Black et al U.S. Pat. No. 5,709,988;
Jagannathan et at U.S. Pat. No. 5,723,278;
Irving et al U.S. Pat. No. 5,728,515;
Bryant et al U.S. Pat. No. 5,728,517;
Maskasky U.S. Pat. No. 5,733,718;
Jagannathan et al U.S. Pat. No. 5,736,312;
Antoniades et al U.S. Pat. No. 5,750,326;
Bruttst et al U.S. Pat. No. 5,763,151; and
Maskasky et al U.S. Pat. No. 5,792,602.

Typically the {111} tabular grain emulsions are those in which the {111} tabular grains account for greater than 50 percent, preferably 70 and optimally 90 percent, of total grain projected area. High bromide emulsions in which {111} tabular grains account for substantially all (>97%) of total grain projected area are disclosed in the patents of List T cited above and are specifically contemplated. The {111} tabular grains preferably have an average thickness of less than 0.3 μm and most preferably less than 0.2 μm. It is specifically contemplated to employ ultrathin tabular grain emulsions in which the tabular grains having a thickness of less than 0.07 μm account for greater than 50 percent of total grain projected area.

When tabular grain emulsions are relied upon for latent image formation upon exposure to blue light, they can have the thickness characteristics noted above. However, to obtain speed by absorption of blue light within the grains, it is recognized that the tabular grains having a thickness of up to 0.50 μm can account for at least 50 percent of total grain projected area in the blue recording layer units.

The high bromide {111} tabular grains preferably have an average aspect ratio of at least 5, preferably greater than 8. Average aspect ratios can range up to 100 or higher, but are typically in the range of from 12 to 60. The average ECD of the latent image forming emulsions is typically less than 10 μm, with mean ECD's of less than 6 μm being particularly preferred to maintain low levels of granularity.

The latent image forming high bromide silver halide grains are chemically sensitized with conventional middle chalcogen and/or noble metal sensitizers. A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157. Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

(II)

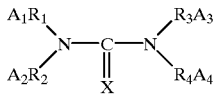

wherein

X is sulfur, selenium or tellurium;

each of $R_1$, $R_2$, $R_3$, and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(III)}$$

wherein

L is a mesoionic compound;

X is an anion; and $L^1$ is a Lewis acid donor.

Other middle chalcogen and noble metal sensitizers are described in *Research Disclosure*, Item 38957, IV. Chemical sensitization. Noble metal sensitizers other than gold are platinum metals (platinum, palladium, rhodium, ruthenium, iridium and osmium).

When the photographic element (I) is intended to record imagewise exposures in only the blue region of the spectrum, native sensitivity of the silver halide grains can be relied upon for photon capture, particularly when the grains contain at least some iodide. Light absorption in the blue region of the spectrum can be significantly improved by the addition of one or more blue absorbing spectral sensitizing dyes. For recording exposures in the green and red regions of the spectrum spectral sensitizing dye is required in all instances. Spectral sensitizing dyes adsorbed to the latent image forming grain surfaces can take any convenient conventional form and can take any of the forms described in *Research Disclosure*, Item 38957, V. Spectral sensitization and desensitization, A.

Sensitizing dyes, and the List T patents, here incorporated by reference.

When the latent image forming emulsion layer is employed to form a black and white image, development of the latent image forming silver halide grains can be relied upon to produce a viewable black and white image. It is possible alternatively to form a so-called "chromogenic" black and white image.

In this instance one or more dye image forming materials, such as image dye-forming couplers, are incorporated in the latent image forming emulsion layer to supplement the image density imparted by developed silver halide grains. It is alternatively possible to form a single color image relying entirely on dye image forming materials for image density. For example, undeveloped silver halide and developed silver can be removed during processing, is is routinely done during color processing, to leave a dye only image. The dye: only image can be of any desired hue. It is common practice to employ a mixture of yellow, magenta and cyan dye forming couplers to form a neutral density image. It is also recognized that dye image-forming couplers can be selected to form so called "neutral density" dyes—i.e., black or nearly black dyes.

Conventional image dye forming compounds and related dye image modifying compounds can be selected from among those disclosed in *Research Disclosure*, Item 38957, X. Dye image formers and modifiers. In one preferred form of the invention the latent image forming emulsion layer contains one or more image dye-forming couplers to generate a viewable dye image.

The reflective layer contains high bromide tabular grains. To perform a light reflecting function, the high bromide tabular grains can take any of the silver halide compositions described above for the image recording layer units. The thickness of the tabular grains controls their ability to reflect light efficiently within the visible spectrum. It is contemplated to employ in the reflective layer tabular grains having thicknesses in the range of from 0.03 to 0.15 $\mu$m. The tabular grains are most efficient in reflecting blue light in the thickness range of from 0.12 to 0.15 $\mu$m. The tabular grains are most efficient in reflecting green light in the thickness range of from 0.07 to 0.12 $\mu$m. The tabular grains are most efficient in reflecting red light in the thickness range of from 0.03 to 0.07 $\mu$m. The tabular grains also reflect blue, green and red light outside the optimum thickness ranges noted above. It is therefore contemplated to employ tabular grains having thicknesses falling below the preferred optimum thickness range for a selected wavelength, since, on a constant silver coating coverage basis, more tabular grains can be coated. The larger number of thinner reflective tabular grains can offset the lack of an optimum thickness for light reflection. For example, by employing reflective grains for blue light reflection that are substantially less than 0.12 $\mu$m in thickness, it is possible to increase the number of tabular grains without increasing the coating coverage of silver. The larger number of grains compensates for the decline in blue light reflection per grain.

Reflective tabular grain coating coverages in the range of from 0.1 to 1.5 g/m$^2$, based on silver, are contemplated.

Preferred coating coverages are in the range of from 0.2 to 1.0 g/m$^2$, based on silver.

The tabular grains in the selected thickness range are further chosen to exhibit an average aspect ratio of greater than 20, preferably greater than 30, and most preferably greater than 40. Thus, the average ECD of these grains is in all instances greater than 0.6 $\mu$m. It is generally taught that latent image forming tabular grains should have an average ECD of no higher than 10 $\mu$m, since granularity is unacceptably high above this level for most, if not all, imaging applications. This restriction on maximum average ECD has no applicability to any of the silver halide grains in the reflective layer when none of these grains cause a dye image to be formed and hence have no impact on image granularity in the recording layer units. Thus, the maximum ECD of the tabular grains of selected thickness can range up the limits of convenience for emulsion preparation. For example, average ECD's of up to 15 or even 20 $\mu$m are contemplated. As the average ECD of the grains increases, the proportion of the grains accounted for by the edges (e.g., the portion of the grain volume that lies within 0.1 $\mu$m of an edge) is reduced, and the specularity of light transmission and reflection is enhanced. This contributes to increasing image sharpness.

It is possible to employ in the reflective layer high bromide tabular grains in the selected thickness range that are present with silver halide grains that are non-tabular or arc tabular but exhibit thicknesses outside the selected thickness range. For example, it is possible to incorporate in the reflective layer a high bromide silver halide emulsion in which the tabular grains in the selected thickness range are precipitated along with other grains. The presence of grains outside the selected thickness range increase total silver coverages and reduce the overall efficiency of the reflective layer. It is therefore preferred to minimize the presence of grains outside the selected thickness range. Preferably the tabular grains in the selected thickness range account for greater than 70 percent of total grain projected area and most preferably greater than 90 percent of total grain projected area in the reflective layer. Since tabular grain emulsions can be readily precipitated with very little variance in tabular grain thickness, it is possible to precipitate tabular grain emulsions in which tabular grains within the selected thickness range account for greater than 99 percent of total grain projected area.

The patent teachings of List T are enabling for the preparation of high bromide tabular grain emulsions for use in the reflective layer, with the following patents particularly teaching high proportion, of tabular grains: Saitou et al U.S. Pat. No. 4,797,354; Tsaur et al 5,147,771, '772, '773, 5,171,659, 5,210,013, and Antoniades et al U.S. Pat. No. 5,250,403. Sutton et al U.S. Pat. No. 5,334,469 is an improvement on the teachings of Tsaue et al that further demonstrates selections of tabular grain thicknesses within the selected range.

It has been discovered quite unexpectedly that the addition of high chloride silver halide epitaxy to the edges of the reflective tabular grains increases imaging speeds. The high chloride silver halide epitaxy contains greater than 50 mole percent chloride, based on silver forming the epitaxy. Silver chloride preferably accounts for greater than 70 mole percent (optimally greater than 90 mole percent) of the silver forming the epitaxy. Epitaxy formed without the intentional addition of bromide or iodide ion is specifically contemplated. Since the host grains contain greater than 50 mole percent bromide, based on silver, and silver bromide and silver chloride are mutually miscible in all proportions, some bromide inclusion in the epitaxy is to be expected. The limited solubility of silver iodide in silver chloride limits iodide inclusion in the epitaxy to less than 10 mole percent, based on silver in the epitaxy. When the host tabular grains are silver bromide grains, epitaxy can be formed that contains no iodide. It is preferred to minimize the inclusion of iodide in the epitaxy.

The high chloride silver halide epitaxy can increase imaging speed even when present in very small amounts. A minimum preferred epitaxy concentration is at least 0.1 mole percent, based on tetal silver forming the composite (epitaxy and host) grains. A specifically preferred minimum epitaxy concentration is at least 1 mole percent, based on total silver forming the composite grains. Epitaxy concentrations as high as 50 mole percent, based on total silver forming the composite grains, are contemplated, but a preferred maximum epitaxy concentration is 25 mole percent, based on total silver forming the composite grains.

By restricting the epitaxy to the edges of the grains (within 0.1 ξm of the edge of the major faces) the specularly reflective qualities of the major faces of the host tabular grains are preserved. Although epitaxy can be restricted to the corners of the host tabular grains, as is preferred when composite grains containing epitaxy are employed for imaging, in this non-imaging application for the composite grains, no advantage has been realized for corner specific epitaxy as compared to edge (including comer) epitaxy.

The composite tabular grains incorporated in the reflective layer can be prepared by conventional techniques. The composite grains can be prepared by following the teachings of Maskasky U.S. Pat. No. 4,435,501, Daubendiek et al U.S. Pat. Nos. 5,494,789, 5,503,971 and 5,576,168, Eshelman et al U.S. Pat. Nos. 5,612,175, 5,612,176 and 5,614,176, and Levy et al U.S. Pat. No. 5,612,177, the disclosures of which are here incorporated by reference. Although the preparation techniques of the patents can be employed to provide composite grains satisfying the descriptions set out above, it is appreciated that the composite grains are used in a manner entirely untaught by these patents. Specifically, whereas these incorporated by reference patents teach the use of composite grains for latent image formation, the composite grains employed in the practice of the invention do not themselves form a viewable image.

The absence of any compound adsorbed to the surface of the tabular grains in the reflective layer that absorbs light in the wavelength range of response by the latent image forming grains is contemplated. For example, if the latent image forming grains are spectrally sensitized to the green portion of the spectrum, no green absorbing spectral sensitizing dye is adsorbed to the surfaces of the tabular grains in the reflective layer. Preferably the reflective layer is entirely free of any compound that absorbs light in the spectral region or regions in which the latent image forming grains are intended to respond.

The absence of spectral sensitization in itself renders the grains in the reflective layer incapable of participating in latent i image formation when exposed in the minus blue (i.e., green or red) region of the spectrum. Hence, it is immaterial in this instance whether the grains are or are, not chemically sensitized, and it is immaterial whether any image dye forming compound is present in the reflective layer. When exposure in the blue region of the spectrum is contemplated, no latent image is formed by the grains n the reflective layer in the absence of chemical sensitization. When the grains are chemically sensitized, blue light exposure that forms a latent image (attributable to native blue sensitivity) can be prevented from forming a viewable image by withholding image dye forming compound from the reflective layer.

The remaining features of the color photographic element (I) can take any convenient conventional form. In addition to the silver halide grains and image dye providing compound, when present, the latent image forming emulsion layer and reflective layer as well as all other processing solution permeable layers, in element (I) the protective overcoat and the antihalation layer, contain processing solution permeable vehicle. The vehicle is typically comprised of 20 hydrophilic colloid, such as gelatin or a gelatin derivative, as well as vehicle extenders and hardener, examples of which are listed in *Research Disclosure*, Item 38957, II. Vehicles, vehicle extenders, vehicle-like addenda and vehicle related addenda. The layer containing latent image forming silver halide grains additionally usually contain antifoggants and/or stabilizers, such as those listed *Research Disclosure*, Item 38957, VII. Antifoggants and stabilizers.

The antihalation layer shown in element (I) is not essential, but is highly preferred to improve image sharpness. When the antihalation layer is coated on the back side of the support, as shown in element (I), it also functions as an anticurl layer. The antihalation layer unit alternatively can be coated between the reflective layer and the transparent film. In addition to vehicle the antihalation layer contains light absorbing materials, typically dyes, chosen to be decolorized (discharged) on processing, a summary of which is provided in *Research Disclosure*, Item 38957, VIII. Absorbing and scattering materials, B. Absorbing materials and C. Discharge.

The protective overcoat is not essential, but is highly preferred to provide physical protection to the underlying emulsion layer. In its simplest form the protective overcoat can consist of a single layer containing a hydrophilic vehicle of the type described above. The protective overcoat is a convenient location for including coating aids, plasticizers and lubricants, antistats and matting agents, a summary of which is provided in *Research Disclosure*, Item 38957, IX. Coating and physical property modifying addenda. Additionally, ultraviolet absorbers are often located in the protective overcoat, illustrated in *Research Disclosure*, Item 38957, UV dyes/optical brighteners/luminescent dyes. Often the protective overcoat is divided into two layer, with the above addenda being distributed between these layers. It is also common practice to place a layer similar to the protective overcoat in the back side of tc support containing surface property modifying addenda. When an antihalation layer is coated on the back side of the support, surface modifying addenda are usually incorporated in this layer.

The transparent film support can take any convenient conventional form. The film support is generally understood to include subbing layers placed on the film to improve the adhesion of hydrophilic colloid layers. Conventional transparent film support characteristics are summarized in *Research Disclosure*, Item 38957, XV. Supports (2), (3), (4), (7), (8) and (9).

When the photographic film is intended to be scanned, either for image retrieval or for retrieving information incorporated during manufacture for aiding exposure or processing, they can contain features such as those illustrated by *Research Disclosure*, Item 38957, XIV. Scan facilitating features. When a magnetic recording layer is incorporated in the color film, it is preferably located on the back side of the film support.

It is specifically contemplated to replace the single latent image forming emulsion layer in element (I) with two or mote latent image forming emulsion layers differing in speed. The advantages of employing two or more emulsion layers is that speed can be increased and image noise (i.e., granularity) can be reduced by this arrangement. Another advantage is that the exposure latitude of the film can be extended. It is generally preferred that, when two or more emulsion layers differing in speed are provided for latent image formation, each layer differ in speed by at least 0.3 log E to 0.9 log E from the speed of the emulsion layer closest in speed.

The following are illustrations of photographic elements according to the invention containing two or more latent image emulsion layers differing in speed:

| |
|---|
| Protective Overcoat |
| Fast Latent Image Forming Layer |
| Reflective Layer |
| Slow Latent Image Forming Layer |
| Transparent Film Support |
| Antihalation Layer |
| (IV) |
| Protective Overcoat |
| Fast Latent Image Forming Layer |
| Mid Latent Image Forming Layer |
| Reflective Layer |
| Slow Latent Image Forming Layer |
| Transparent Film Support |
| Antihalation Layer |
| (V) |
| Protective Overcoat |
| Fast Latent Image Forming Layer |
| Reflective Layer |
| Mid Latent Image Forming Layer |
| Slow Latent Image Forming Layer |
| Transparent Film Support |
| Antihalation Layer |
| (VI) |

For the maximum increase in photographic speed, the reflective layer is located immediately beneath the fast latent image forming emulsion layer. When the reflective layer is moved beneath two or three overlying latent image forming emulsion layers differing in speed, contrast is increased and speed gains can become small.

In color photographic elements capable of creating separate records of blue, green and red light during imagewise exposure a typical layer arrangement is illustrated by the following:

| |
|---|
| Protective Overcoat |
| Blue Recording Layer Unit |
| Green Recording Layer Unit |
| Red Recording Layer Unit |
| Antihalation Layer Unit |
| Transparent Film Support |
| (VII) |

One, any two, or each of the blue, green and red recording layer units can be constructed with the combination of one or more latent image forming emulsion layers and a reflective layer described above in connection with elements (I) and (IV) through (VI). The latent image forming grains in the blue recording layer can rely on native blue sensitivity or be spectrally sensitized with one or a combination of adsorbed blue absorbing spectral sensitizing dyes. The latent image forming grains in the green recording layer unit are spectrally sensitized with one or a combination of adsorbed green absorbing spectral sensitizing dyes. The latent image forming grains in the red recording layer unit are spectrally sensitized with one or a combination of adsorbed red absorbing spectral sensitizing dyes.

While it is possible to form distinguishable image records in the blue, green and red recording layer units without incorporating any image dye providing compound in the recording layer units of element (VII), the processing techniques (illustrated by the Kodak Kodachrome K-14 process, Mannes et al U.S. Pat. No. 2,252,718, Schwan et al U.S. Pat. No. 2,950,970 and Pilato U.S. Pat. No. 3,547,650) are comparatively complicated. It is therefore preferred to incorporate in the recording layer units image dye providing compounds, with image dye-forming couplers being specifically preferred for incorporation. When the photographic elements are intended to be used for exposing a color paper or to form viewable reversal color images, the blue, green and red recording layer units contain dye-forming couplers that form on coupling yellow, magenta and cyan image dyes, respectively. When the photographic elements are intended to be scanned, an image dye of any convenient hue can be formed in any of the blue, green and red recording layer units, provided that the Image dyes can be differentiated by inspection or scanning. To facilitate scanning each image dye is contemplated to exhibit a half peak absorption bandwidth of at least 25 nm, preferably 50 nm, that does not overlap the half peak absorption bandwidth of any image dye in another recording layer unit. Yellow, magenta and cyan dye image-forming couplers can take any of the various forms disclosed in *Research Disclosure*, Item 38957, X. Dye image formers and modifiers, B. Image-dye-forming couplers.

To avoid color contamination of the blue, green and red recording layer units, it is conventional practice to incorporate an oxidized developing agent scavenger (a.k.a. antistain agent) in the layer units to prevent migration of oxidized color developing agent from one layer unit to the next adjacent layer unit. Preferably the oxidized color developing agent is located in a separate layer, not shown in (I) above, at the interface of the layer units. Antistain agents are summarized in *Research Disclosure*, Item 38957, D. Hue modifiers/stabilization, paragraph (2).

It is also preferred to locate a blue filter material, such as a processing solution decolorizable yellow dye or Carey Lea silver, in a layer between the latent image forming grains in the blue recording layer unit and the next adjacent layer unit. These filter materials are also disclosed in *Research Disclosure*, Item 38957, VIII. Absorbing and scattering, materials, B. Absorbing materials and C. Discharge.

The films of invention are specifically contemplated for use in cameras used to capture visible light images of photographic subjects. Exposures can range from high intensity, short duration exposures to low intensity, long duration exposures. Since the present invention offers the capability of increasing speeds, shorter exposures at lower lighting intensities are specifically contemplated. For example, the present invention is particularly suited for producing color films having ISO ratings higher than 200, preferably higher than 400 and optimally higher than 1000. The films can be employed in cameras intended for repeated use or only limited use (e.g., single-use) cameras. Contemplated features of limited use cameras are disclosed in *Research Disclosure*, Item 38957, XVI. Exposure, (2).

Once imagewise exposed, the photographic films of the invention can be processed in any convenient conventional manner to produce silver only images, dye only images or silver and dye images that correspond to the latent images in the recording layer units or that are reversals of the latent images. Most commonly, incorporated in the blue, green and red recording layer units are negative-working emulsions which produce a color negative dye image when subjected to a single color development step. If direct-positive emulsions are substituted in the recording layer units, a single color development step produces a positive dye image—i.e., a reproduction of the subject photographed. When negative-working emulsions are incorporated in the recording layer units, reversal processing (black-and-white development followed by color development) is capable of producing a positive dye image. Illustrations of conventional processing systems are provided by *Research Disclosure*, Item 38957, XVIII. Chemical development systems.

A specifically preferred processing system is the Kodak Flexicolor ™C-41 color negative process. It is specifically contemplated to introduce modifications to the color film and the process to permit development times of less than 2 minutes with improved results, as illustrated by Becher et al U.S. Ser. No. 09/014,842, filed Jan. 28, 1998; U.S. Ser. No. 09/015,720, filed Jan. 29, 1998; and U.S. Ser. No. 09/024,335, filed Feb. 17, 1998; each commonly assigned and currently allowed, here incorporated by reference.

It is specifically contemplated to incorporate in the latent image forming emulsion layer of element (I) and in the fast latent image forming emulsion layers of elements (IV) through (VI) randomly oriented light scattering silver halide grains free of adsorbed dye that absorbs light in the wavelength region the emulsion layer containing these grains is intended to record. For example, if the latent image forming emulsion layer is intended to record blue, green or red light, then the light scattering grains are free of blue, green or red absorbing dye, respectively. Preferably no dye of any hue is adsorbed to the light scattering grains.

When the photographic element contains blue, green and red recording layer units, as in element (VII), it is appreciated that locating the light scattering grains in any recording layer unit will increase the speed of that layer unit with little, if any, degradation of its image sharpness. However, if the recording layer unit containing scattering grains overlies another recording layer unit, significant degradation in image sharpness maybe observed in one or more of the underlying recording layer units. Thus, in clement (VII) the light scattering grains arc preferably limited to the red recording layer unit, since there is no underlying recording layer unit to suffer image sharpness degradation as a result of light scattering in the red recording layer unit. In other words, the benefits of the invention are realized with no offsetting reductions in image sharpness.

It is contemplated to select the light scattering grains from among the grain compositions described for the latent image forming grains. The light scattering grains are coated at a coverage of from 0.01 to 0.2, preferably 0.03 to 0.17, $g/m^2$, based on silver. These light scattering grains arc randomly oriented as coated in the latent image forming layer to increase light scattering, as compared to light reflection or transmission. The grains can be of any convenient conventional crystal shape that can be randomly oriented as coated. This excludes the use of tabular grain emulsions to provide light scattering grains. Tabular, rod-like and other acicular grains are well recognized to orient their major crystal axes parallel with the support surface. Preferred light scattering grains are regular grains, including octahedral, cubic, tetradecahedral, rhombic dodecahedral, and spherical grains. Alternatively, the grains can be non-tabular irregular grains, such as multiply twinned grains. Minor proportions of tabular grains can be tolerated, but are preferably excluded from the light scattering grain population.

To facilitate light scattering the grains are contemplated to exhibit ECD's in the range of from 0.15 to 0.8 $\mu$m, as taught by Locker U.S. Pat. No. 3,989,527, the disclosure of which is here incorporated by reference. As is well understood in the art the efficiency of light scattering is highest in the blue region of the spectrum at or near the lower end of the size range. At or near the higher end of the size range, the efficiency of light scattering is highest in the red region of the spectrum. However, as noted above in connection with the reflective grains, it is possible to select light scattering grains of a less than optimum size for light scattering in a specific wavelength range, since, the additional grains that can be coated on a constant silver coating coverage basis allows a larger number of grains to be coated. Thus, even though on a grain for grain comparison light scattering is less efficient, on a constant coating coverage basis smaller grain populations can actually equal or exceed the scattering ability of grain sizes optimized for light scattering at a particular wavelength.

The light scattering grains can be coprecipitated and coated with other grains. It is, of course, possible and preferred to minimize the presence of grains outside the indicated ECD range. Preferably greater than 90 percent of the total silver is in the light scattering grains in any emulsion to be blended with the latent image forming grains. It is possible to precipitate emulsions in which substantially all (greater than 99 percent) of the grains are regular grains within the indicated ECD range.

To facilitate light scattering, the light scattering grains, like the light reflecting composite grains, are free of adsorbed dye that absorbs in the wavelength range of intended light scattering. The light scattering grains, like the light reflecting composite grains, are not imaging grains. The light scattering grains are not chemically sensitized when used to scatter blue light and preferably not chemically sensitized when used to scatter minus blue light.

EXAMPLES

The invention can be better appreciated by reference to the following specific embodiments. Component coating coverages, in parenthesis, are reported in units g/m$^2$. Silver halide coating coverages are based on the weight of silver. The suffix E identifies elements as satisfying the requirements of the invention while suffix C identifies comparative elements.

Components Identified by Acronym

CC-1

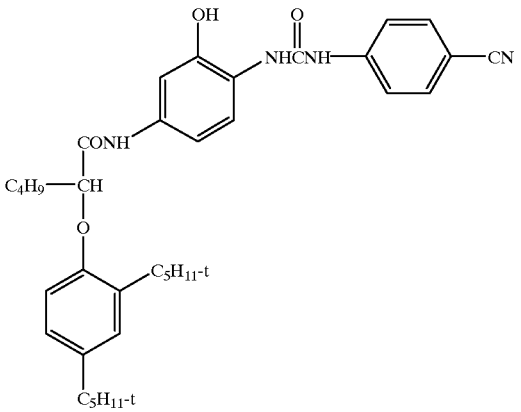

-continued

CC-2

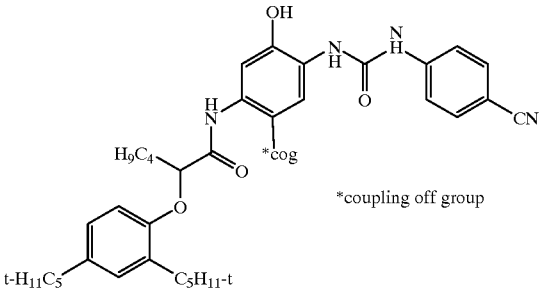

CM-1

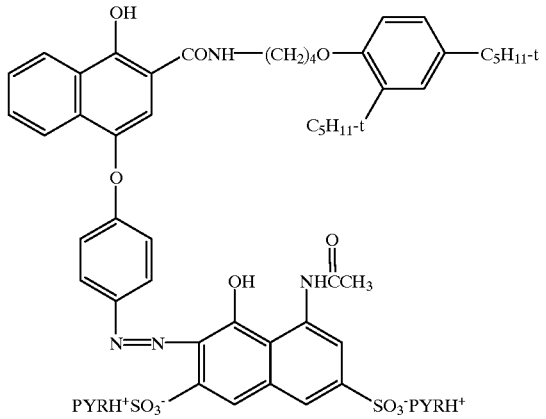

IR-1

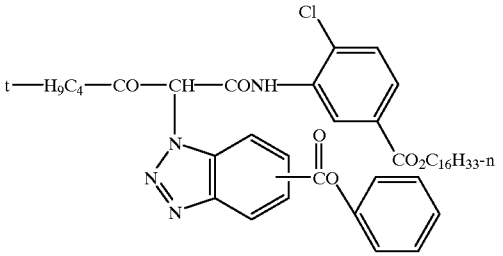

IR-3

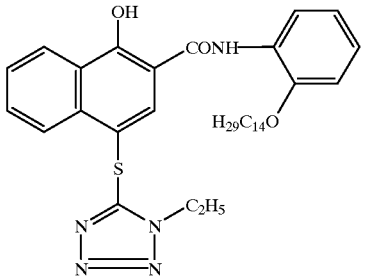

-continued

IR-4

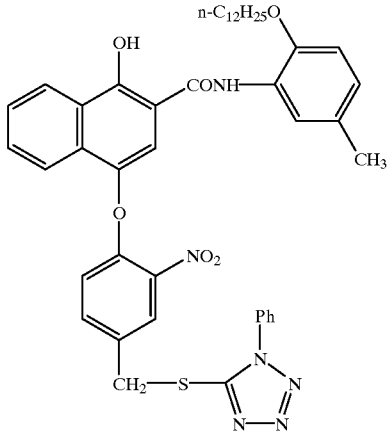

OxDS-1

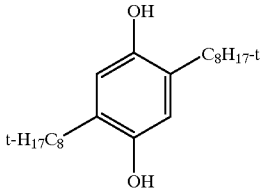

UV-2

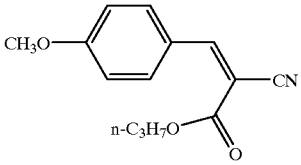

UV-1

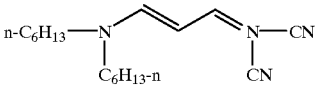

RSD-1

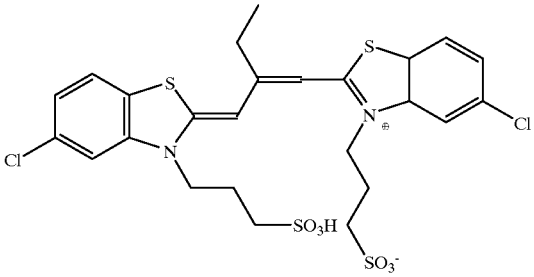

RSD-2

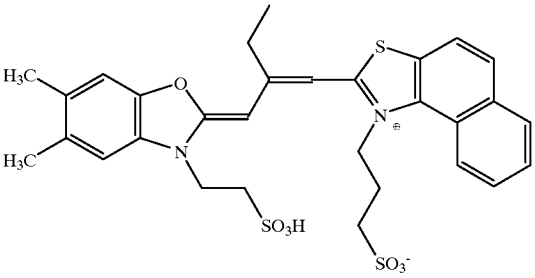

-continued

B-1

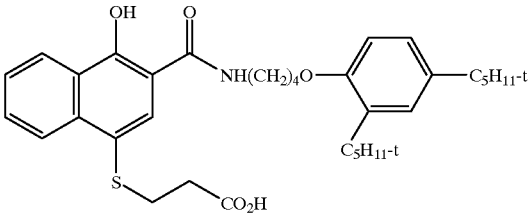

Single Layer Reflectance

A series of single emulsion layer coatings were prepared to observe reflectance at 650 nm. A single emulsion layer was acetated on a cellulose coated film support. The 650 nm reflectance of the following emulsions were compared:

Emulsion A This was a silver bromide tabular grain emulsion in which tabular grains accounted for greater than 90 percent of total grain projected area. The tabular grains exhibited a thickness of 0.07 $\mu$m and an average ECD of 5.9 $\mu$m. No epitaxy was associated with the grains.

Emulsion B This emulsion was similar to Emulsion A, except that the average ECD was 2.6 $\mu$m.

Emulsion C This was a composite grain emulsion. The host grains were silver bromide tabular grains accounting for greater than 90 percent of total grain projected area. The tabular grains exhibited a thickness of 0.10 $\mu$m and an average ECD of 1.8 $\mu$m. Silver chloride was precipitated at the edges of the host grains. The epitaxy accounted for 6 mole percent of the total silver forming the grains.

Emulsion D This was a composite grain emulsion similar to C, except that the average ECD of the host grains was 4.0 $\mu$m.

Emulsion coating coverages, based on silver, are reported in Table I. Percent reflectance by the emulsions at 650 nm was determined by measuring total reflectance and subtracting film support reflectance.

TABLE I

| Emulsion | Ag Coverage ($g/m^2$) | % Reflectance @ 650 nm |
|---|---|---|
| A(ECD 5.9, t 0.07) | (0.49) | 22 |
| A | (0.89) | 33 |
| A | (1.29) | 37 |
| B(ECD 2.6, t 0.07) | (0.46) | 24 |
| B | (0.90) | 34 |
| B | (1.29) | 38 |
| C(ECD 1.8, t 0.1, epitaxy) | (0.86) | 19 |
| D(ECD 4.0, t 0.1, epitaxy) | (0.86) | 19 |

From Table I it can be estimated that doubling silver coating coverages up to about 1.0 $g/m^2$ increases 650 nm reflectance by about 10 percent. Further increases in silver coating coverages increase reflectance, but to a significantly lesser extent.

By comparing Emulsion A to Emulsion B and Emulsion C to Emulsion D, it is apparent that reflectance is not greatly influenced by grain ECD.

Understanding the reflectance differences between Emulsions C and D as compared to Emulsions A and B is difficult to interpret, since the tabular grain thicknesses differ significantly. If the reflectances of Emulsion C and D are increased 30% to reflect the fewer number of grains per square meter, these emulsions are still not as reflective as Emulsions A and B at similar coating coverages. Either the difference in tabular grain thickness or the epitaxy is responsible for this shortfall. In any event, it is apparent that the epitaxy is not increasing reflectance.

Multilayer Elements

A series of color photographic elements were constructed differing only in Layer 3. In comparison element IC Layer 3 was omitted. In the remaining elements Layer 3 contained gelatin (1.077) and OxDS-1 (0.0154), with the grain size choices and coating coverages reported below in Table II. The grains in Layer 3 were in each instance silver bromide tabular grains with tabular grains of the indicated thickness accounting for 99.9 percent of total grain projected area. The elements were hardened with bis(vinylsulfonyl)methane hardener (0.27) uniformly distributed through all of the gelatin containing layers. The antifoggant 4-hydroxy-6-methyl-1,3,3a,7-tetraazaindene was employed, and the elements contained other conventional addenda that remained unchanged from element to element and that did not participate in dye image formation, such as surfactants, high boiling solvents, coating aids, sequetrants, lubricants, matte beads and tinting dyes.

Layer 1 (Protective Overcoat Layer): gelatin at (1.077).

Layer 2 (Fast Cyan layer): a red sensitized (with a mixture of RSD-1 and RSD-2) silver iodobromide tabular grain emulsion: 4.0 μm ECD×0.13 μm t, 4.0 mole % I, based on Ag, at (0.130), cyan dye-forming coupler CC-2 at (0.205), IR-4 (0.025), IR-3 (0.022)-2 at (0.022), OxDS-1 (0.014) and gelatin at (1.45).

Layer 3

Layer 4 (Mid cyan layer): a red sensitized (with a mixture of RSD-1 and RSD-2) silver iodobromide tabular grain emulsion: 2.2μm ECD×0.12 μm t, 3.0 mole % I, based on Ag, at (1.17), cyan dye-forming coupler CC-2 at (0.181), IR-4 (0.011), masking coupler CM-1 at (0.032), OxDS-1 (0.011) and gelatin at (1.61).

Layer 5 (Slow cyan layer): a blend of two red sensitized (all with a mixture of RSD-1 and RSD-2) silver iodobromide tabular grain emulsions: (i) 1.21 μm ECD×0.12 μm t, 4.1 mole % 1, based on Ag, at (0.265) and (ii) 1.0 μm ECD× .0.08 μm t, 4.1 mole % I, based on Ag, at (0.312), cyan dye-forming coupler CC-1 at (0.227), masking coupler CM-1 at (0.032), bleach accelerator releasing coupler B-1 at (0.080), and gelatin at (1.67).

Layer 6 (Antihalation layer): black colloidal silver at (0.151), UV-1 and UV-2, both at (0.075) and gelatin at (2.15).

Support: Cellulose triacetatc.

The elements received identical stepped exposures to allow density (D) versus exposure (log E) characteristic curves to bc plotted for each of the blue, green and red color records. The exposed elements were processed in the Kodak Flexicolor™ C-41 color negative process described in *British Journal of Photography Annual*, 1988, pp. 196–198.

The dye images were analyzed and compared for speed, reported below in relative log units, where a difference in speed of 0.01 log E equals 1 relative log speed unit. Speed was measured at a toe density Ds, where Ds minus Dmin equals 20 percent of the slope of a line drawn between Ds and a point D' on the characteristic curve offset from Ds by 0.6 log E.

Sharpness differences are reported in CMT (cascaded modulation transfer) units. The equations on which CMT is based are reported in James *The Theory of the Photographic Process*, 4th Ed., Macmillan, New York, 1977, p. 629, with a more qualitative explanation being provided by Keller *Science and Technology of Photography*, VCH, New York, 1993, under the topic Modulation Transfer Function, starting at page 175. Negative CMT differences indicate a loss of sharpness.

Speed and sharpness comparisons are -eferenced to comparative element 1C in Table II.

TABLE II

| Element | Layer 3 Emulsion | 650 nm Reflectance | Δ Red Speed / Δ Red CMT |
|---|---|---|---|
| 1C | None | Not Appl. | Not Appl. |
| 2C | A(0.43) | 22 | +6 ÷ −0.4 = 15.0 |
| 3C | A(0.86) | 33 | +14 ÷ −0.5 = 28.0 |
| 4C | A(1.29) | 37 | +16 ÷ −1.3 = 12.3 |
| 5C | B(0.43) | 24 | +8 ÷ −0.5 = 16.0 |
| 6C | B(0.86) | 34 | +14 ÷ −1.0 = 14.0 |
| 7C | B(1.29) | 38 | +15 ÷ −10.1 = 1.48 |
| 8C | C(0.86) | 19 | +16 ÷ −0.9 = 17.8 |
| 9E | D(0.86) | 19 | +13 ÷ −0.4 = 32.5 |

From Table II it is apparent that the speed increase per unit of sharpness loss was higher for Element 9E employing silver bromide tabular grain emulsions with high chloride epitaxy than with any of the reflective layer emulsion coatings lacking epitaxy. This was surprising, since the 360 nm reflectances for Emulsion D containing composite grains (tabular grains with epitaxy) were lower than the corresponding reflectance for the remaining emulsions lacking epitaxy employed in reflective Layer 3.

The much higher speed increase per urit of sharpness loss for Element 9E as compared to Element 8C, both containing composite grain emulsions in Layer 3, is attributable to the fact that Emulsion D in Element 9E exhibited an average aspect ratio of 40, whereas Emusion C in Element 8C exhibited an average aspect ratio of less than 20.

Matched Set Comparisons

Elements similar to 1C through 9E were prepared and tested as described above, but with the emulsions chosen and coated to eliminate differences in tabular grain thicknesses. All of the emulsions exhibited tabular grain thicknesses of0.10 μm. Silver coating coverages in Layer 3 were in each instance 0.86 g/m$^2$. The following additional Layer 3 emulsions were provided for comparison:

Emulsion E This was a silver bromide tabular grain emulsion in which tabular grains accounted for greater than 90 percent of total grain projected area. The tabular grains exhibited a thickness of 0.10 μm and an average ECD of 4.4 μm. No epitaxy was included in the emulsion.

Emulsion F This was similar to composite grain Emulsion D, except that the epitaxy accounted for 20 mole percent of the total silver forming the composite grains.

The results are summarized in Table III.

TABLE III

| Element | Layer 3 Emulsion | Average Aspect Ratio | Δ Red Speed / Δ Red CMT |
|---|---|---|---|
| 10C | None | Not Appl. | Not Appl. |
| 11C | E(no epitaxy) | 44 | +12 ÷ −1.2 = 10.0 |
| 12C | C(epitaxy) | 18 | +18 ÷ −1.8 = 10.0 |
| 13E | D(epitaxy) | 40 | +16 ÷ −0.8 = 20.0 |
| 14E | F(epitaxy) | 40 | +17 ÷ −1.2 = 14.0 |

From Table III it is apparent that the speed increase per unit of sharpness loss ratios were higher for Elements 13E and 14E employing silver bromide tabular grain emulsions with high chloride epitaxy than in Element 11C, which lacked epitaxy on the tabular grains in the reflective layer, or Element 12C, which employed in the reflective layer tabular grains with an average aspect ratio of less than 20. These comparison demonstrate the importance of both an average aspect ratio of at least 20 for the tabular grain emulsion in the reflective layer and the importance of epitaxy.

A comparison of Elements 13E and 14F demonstrates that increasing epitaxy allows the advantages of the invention to be retained, but higher concentrations of epitaxy are not preferred for maximum speed gain to sharpness loss ratios.

The invention has been described in detail with particular reference to certain preferred embodiments thereof, but it will be understood that variations and modifications can be effected within the spirit and scope of the invention.

What is claimed is:

1. A photographic element comprised of a transparent film support and, coated on the support, at least one image forming emulsion layer containing radiation-sensitive silver halide grains (i) comprised of greater than 50 mole percent bromide, based on silver, and (ii) chemically sensitized with at least one of middle chalcogen and noble metal sensitizers, wherein, coated to receive exposing radiation directly from the image forming emulsion layer is a non-imaging layer that doss not form a viewable image upon imaoewise exposure and processing, said non-imaging layer containing composite silver halide grains coated at a coverage of 0.1 to 1.5 g/m$^2$ formed by (a) tabular silver halide grains (i) comprised of greater than 50 mole percent bromide, based on silver, (ii) having a thickness in the range of from 0.03 to 0.20 $\mu$m, and (iii) having an average aspect ratio of greater than 20, and (b) silver halide epitaxy selectively positioned adjacent edged of said tabular grains in said non-imaging layer, said silver halide epitaxy (i) containing greater than 50 mole percent chloride, based on silver, and (ii) accounting for from 0.1 to 50 percent of the total silver in the composite grains.

2. A photographic element according to claim 1 wherein the composite silver halide grains are coated at a coverage of 0.2 to 1.0 g/m$^2$.

3. A photographic element according to claim 1 wherein the tabular grains forming the composite grains have an average aspect ratio of greater than 30.

4. A photographic element according to claim 3 wherein the tabular grains forming the composite grains have an average aspect ratio of greater than 40.

5. A photographic element according to claim 1 wherein the tabular grains forming the composite grains contain greater than 90 mole percent bromide, based on silver in the tabular grains.

6. A photographic element according to claim 1 wherein the silver halide epitaxy contains greater than 90 mole percent chloride, based on silver in the epitaxy.

7. A photographic element according to claim 1 wherein the silver halide epitaxy accounts for from 1 to 25 percent of total silver in the composite grains.

8. A photographic element according to claim 1 wherein the image forming emulsion layer contains a dye image-forming coupler.

9. A photographic element according to claim 8 wherein the image forming emulsion layer contains a red spectral sensitizing dye and the tabular grains forming the composite grains have a thickness in the range of from 0.03 to 0.07 $\mu$m.

10. A photographic element according to claim 8 wherein the image forming emulsion layer contains a green spectral sensitizing dye and the tabular grains forming the composite grains have a thickness of 0.12 $\mu$m or less.

11. A photographic element according to claim 8 wherein the image forming emulsion layer contains a blue spectral sensitizing dye and the tabular grains forming the composite grains have a thickness of 0.15 $\mu$m or less.

* * * * *